US006234481B1

(12) United States Patent
Robertson

(10) Patent No.: US 6,234,481 B1
(45) Date of Patent: May 22, 2001

(54) MULTI-SKILL KNOWLEDGE-BASED GAME

(76) Inventor: Rebecca Jeanne Robertson, 303 Aston Dr., Richardson, TX (US) 75081

( * ) Notice: Subject to any disclaimer, the term of this patent is extended or adjusted under 35 U.S.C. 154(b) by 0 days.

(21) Appl. No.: 09/408,597

(22) Filed: Sep. 30, 1999

(51) Int. Cl.[7] ..... A63F 3/00

(52) U.S. Cl. ..... 273/243; 273/141 R; 273/292; 273/299

(58) Field of Search ..... 273/141 R, 272, 273/299, 236, 243

(56) References Cited

U.S. PATENT DOCUMENTS

| | | | | |
|---|---|---|---|---|
| 540,197 | * | 5/1895 | Stockdell | 273/141 R |
| 1,459,996 | * | 6/1923 | Schwarz | 273/141 R |
| 1,520,725 | * | 12/1924 | Seagrave | 273/141 R |
| 1,606,996 | * | 11/1926 | Hobbs | 273/141 R |
| 1,632,640 | * | 6/1927 | Baer | 273/141 R |
| 1,636,694 | * | 7/1927 | Jacobs et al. | 273/141 R |
| 3,050,303 | * | 8/1962 | Borci | 272/1 |
| 4,236,719 | * | 12/1980 | Kerr | 273/265 |
| 4,690,409 | * | 9/1987 | Scalia | 273/240 |
| 4,846,479 | * | 7/1989 | Hanley | 273/236 |
| 4,884,816 | * | 12/1989 | Ford et al. | 273/240 |
| 5,310,347 | * | 5/1994 | Brand | 434/167 |
| 5,871,211 | * | 2/1999 | Was | 273/242 |
| 6,059,290 | * | 5/2000 | Neil | 273/243 |

* cited by examiner

*Primary Examiner*—Steven Wong
*Assistant Examiner*—D Collins
(74) *Attorney, Agent, or Firm*—Robert H. Frantz

(57) ABSTRACT

A system and method for adapting single-skill level games to multi-skill level play are disclosed. A spinner with multiple levels of results, each representative of results for a particular skill level of play, is used as the random turn advancement device. The method employs the spinner in conjunction with any game intended for single-skill level play, providing for different point levels, movement levels, instructions, or difficulty levels on each turn for each player based on his or her skill level.

6 Claims, 2 Drawing Sheets

MULTI-SKILL KNOWLEDGE-BASED GAME

TECHNICAL FIELD OF THE INVENTION

Figure 1:
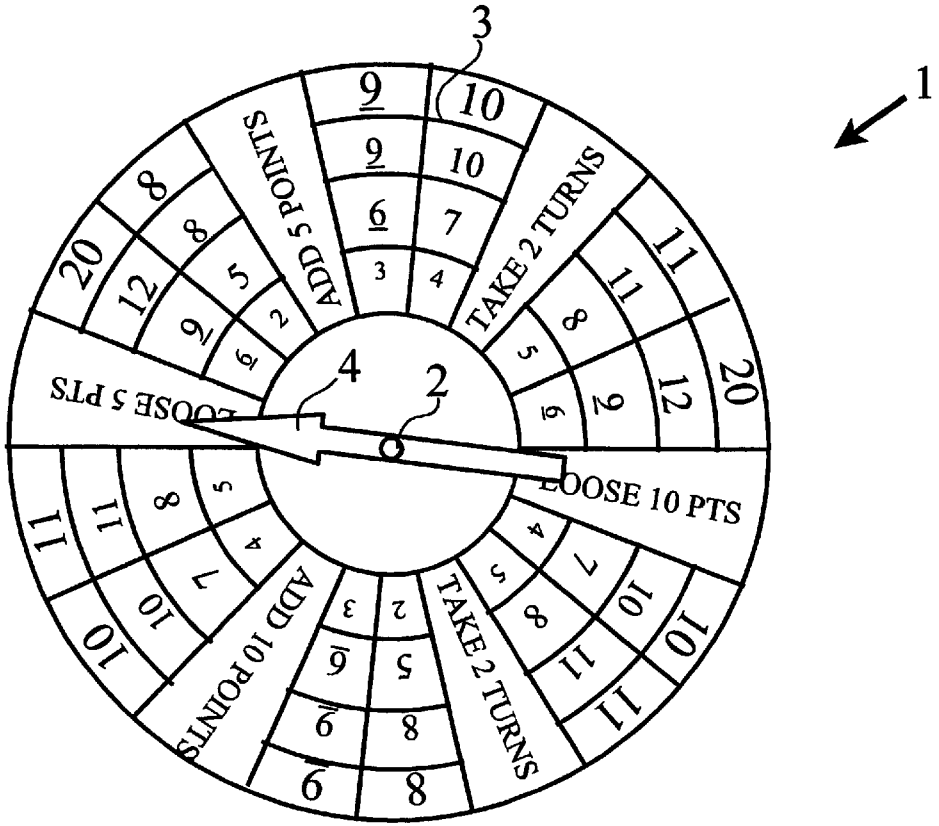

This invention pertains to the arts of board games and the chance devices used to determine player actions and advancement during the game. This invention also pertains to the art of enabling players with varying skill levels to play together using the same board game.

CROSS-REFERENCE TO RELATED APPLICATIONS (CLAIMING BENEFIT UNDER 35 U.S.C. 120)

None.

FEDERALLY SPONSORED RESEARCH AND DEVELOPMENT STATEMENT

This invention was not developed in conjunction with any Federally sponsored contract.

MICROFICHE APPENDIX

Not applicable.

BACKGROUND OF THE INVENTION

Games are a popular means for bringing together groups of people in a spirit of friendly competition for fun and sometimes educational benefit. Many games are designed to strengthen and develop knowledge and skills in certain fields of education, such as spelling, math, or history. Games can be used in many settings including families, friends, schools and institutions. In almost all these groupings, there exists a vast array of skill levels, whether it is members of a family of different ages, friends with different abilities, or a group of students at various levels. This difference in skill levels can potentially reduce the satisfaction of winning and the feeling of fairness received by some players.

Educational and knowledge-based games usually consist of a chance device, such as a spinner or dice, a game board, game pieces for marking each player's position or status within the game, and sometimes one or more card decks. These board games known in the art are limited to a specific game design, and are not generally usable with any other game pieces.

For example, U.S. Pat. No. 5,738,354 to Easley discloses an educational board game requiring a playing board with a pathway, game pieces or tokens, and a card set unique to the game containing categorized questions with a variety of difficulty level questions on each card. A concealment device allows only one question of a given difficulty level to be viewed and read by a player. When the question is answered correctly the player can advance on the board. U.S. Pat. No. 5,906,371 to Peterson discloses another educational board game that requires a similar card set unique to the game, game pieces, and a game board. The players advance around the board or along a path on the board after correctly answering categorized questions in their specific skill level.

Board games are useful in stable, level environments, such as home table tops and desks in schools. However, games with many game pieces can be difficult or impossible to play in moving vehicles or other space constrained areas. Additionally, games which employ game pieces or tokens, a game board, and possibly dice or a spinner can be burdensome to store and retain all the necessary components. Finally, educational board games tend to be inflexible in their subject content, skill level thresholds, and relevancy to current events as the game board and cards must all be updated or replaced as they related to each other heavily.

Card games are popular because they can be played in environments which do not lend themselves well to playing board games, such as airplanes, cars, and beds. Educational card games, such as flash cards, are primarily single player non-competitive games. Some card games, such as those based on a stand enjoy the flexibility of being able to play multiple games with the same materials, but do not lend themselves to multi-skill level play well. For example, various forms of poker can be played with a standard card deck, but players of a lower skill level are at a distinct disadvantage.

U.S. Patent 5,882,258 to Kelly, et al, discloses a card game which allows for multi-skill level play, but does so by relying upon timers to complete actions. Such a game is useful for odds-based games, such as blackjack, whereby limiting the time a player has to calculate or estimate odds can adjust a degree of difficulty. However, such a card game which employs time limits is not especially well adapted for knowledge-based subjects such as history or spelling. Also, the need for timers may make this card game less useful in some of the environments previously discussed.

Therfore, there is a need in the art for a game apparatus and a method of use thereof, which can be readily and simultaneously played by a plurality of players of varying skill levels in a variety of environments, such as on table tops or in moving vehicles. This apparatus should eliminate reliance upon game boards and game pieces to play a game, and should enhance the ability to store it without lost pieces. Further, there is a need in the art to be able to upgrade the game, or modify its subject content without the expense of replacement of these items.

SUMMARY OF THE INVENTION

The invention disclosed herein provides a spinner mechanism, and method for use thereof, which allows for multi-skill level play of practically any educational or knowledge-based game by assigning results of a spin different values based on the skill level of the player operating the spinner.

DETAILED DESCRIPTION OF THE INVENTION

The following disclosure, when taken in conjunction with the presented figures and tables, sets forth the invention previously described in the SUMMARY OF THE INVENTION.

The spinner consists of a spinner device, on which is provided a set of concentric circles which determine the results for different player skill levels. The "skill rings" may be color coded to coordinate with special indicia on a game board or decks of cards. Additionally, the spinner can be used with different standard board games and card games and other games now on the market, thereby providing some direct relationship to the standard board game. A specific board game, one which promotes spelling education, is disclosed, which uses the spinner both as an invention and example for use of the method.

Turning to FIG. 1, the spinner device (1) consists of multiple sets of concentric rings (3) with a center connection point (2). The center connection point holds a pointer (4) which freely spins with a touch or flick of a finger. Skill levels begin at the lowest level on the inside ring and increase in difficulty as the rings progress towards the outside. The rings are radially divided into spaces, defining spaces between the rings and the radial divider lines. The spaces contain results of a spin for a particular skill level of play. In the preferred embodiment, the spaces contain numbers, the value of which around the ring in a clockwise manner. Further in the preferred embodiment, each circle can be color coded to match card sets or game board indicia. This general design of the spinner allows it to be used in any game that uses a means of determining a number of points or spaces to be moved on a game board. This also allows easy adaptation of a single-skill level game to multi-skill level play.

Figure 2A:
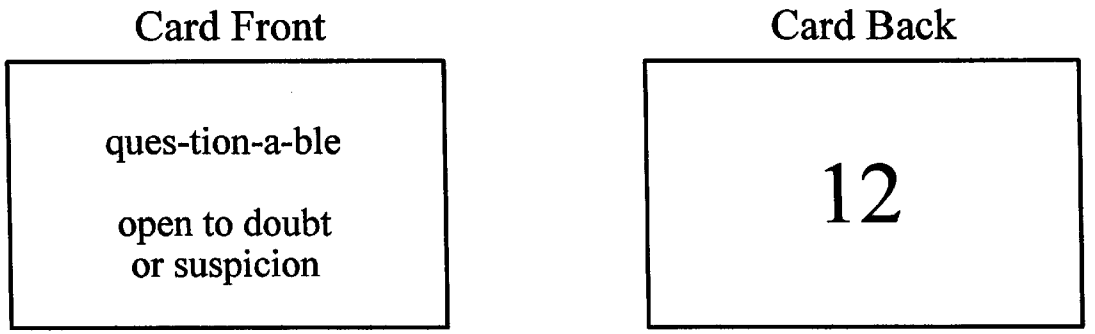
Figure 2B:
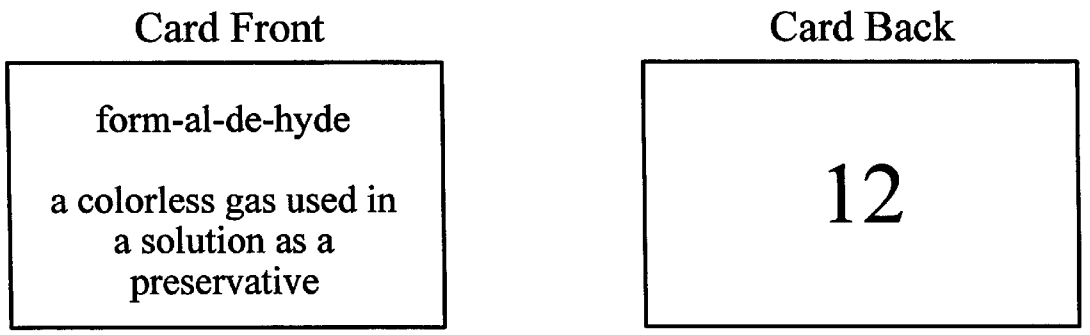

FIGS. 2*a* and 2*b* show the front and back, respectively, of representative cards from a spelling and vocabulary game which can be used in conjunction with the spinner. This game is designed to strengthen spelling and vocabulary abilities of each of the players as well as basic addition and subtraction skills. The cards are preferably color coded to match the skill levels on the spinner.

At the beginning of the game, the cards are separated in stacks or decks by like numbers. On the back of each card is a number representing the number of letters contained in the word on the front or face of the card. In the preferred embodiment, green is used on the inner ring of the spinner for the lowest skill level, and the numbers in the green ring range from 2 to 6. Therefore, there are 5 decks of cards, one each for words with 2 letters, 3 letters, 4 letters, 5 letters and 6 letters. This is repeated for each play level, using a different color and range of numbers.

To start play of the game, a player is selected for the first turn. Each player starts with zero points. This can be done by each player spinning the spinner once, and the player receiving the highest number of points on the outside ring on their spin is set to be the first player. Then, play progresses around the table or group in an orderly fashion, such as clockwise or counterclockwise. As each player takes a turn, he or she spins the spinner.

As each turn is taken, the total number of points for that section is written down and added or subtracted from the previous total. Another player takes the top card from the proper deck for that player based on the results of the spin. For example, in the preferred embodiment, when a beginner player receives a "3" on his or her spin, another player takes the top card from the deck of green cards marked 3. This player then reads the card, such as the word to be spelled. If the player whose turn it is correctly spells the word (or answer the question as in other games), the number of points indicated on the outside ring of the spinner is added to that player's current total.

If a player's spin lands on a spinner section that does not have numbers in the outer ring and has instructions in the inner section, the player must follow the directions given in that section. Play continues until one player reaches a pre-determined number of points, such as 100.

To enhance the game, players who fail to spell a word (or answer a question) correctly may have the same number of points deducted from their score. A further enhancement of the game may be to place a time limit on responding to the question, although this is not required to achieve the objects of the invention.

Additionally, bonus points may be awarded for additional knowledge demonstrated at the time of a player's turn, such as correctly reciting the meaning of a word which has been correctly spelled.

For a more complete understanding of an example game which can employ the method disclosed supra, TABLE 1 sets forth some example spelling words which may be used on the various card decks as disclosed.

TABLE 1

Example Spelling Words

| Level | Letters | Word | Meaning |
|---|---|---|---|
| 1 | 5 | cu-bic | having three dimensions or the formof a cube |
| 1 | 5 | de-cor | style of decoration |
| 1 | 5 | ig-loo | an Eskimo hut, usually built of hard snow |
| 1 | 5 | ma-ni-a | excessive enthusiasm or desire |
| 1 | 5 | mous-y | resembling a mouse as in color or odor |
| 1 | 6 | ver-i-fy | to prove the truth |
| 1 | 6 | scroll | a roll of parchment, paper with writing on it |
| 2 | 6 | wor-thy | deserving respect or support |
| 2 | 6 | plunge | to thrust or go forcefully into something |
| 2 | 6 | savory | having an appetizing taste or smell |
| 2 | 6 | the-o-ry | a set of ides formulated to explain something |
| 3 | 8 | trav-es-ty | a ridiculous or shameful imitation |
| 3 | 8 | cel-lu-lar | pertaining to or characterized by cells |
| 3 | 8 | pro-lif-ic | producing offspring, fruit, etc. Abundantly |
| 3 | 8 | medi-o-cre | of only ordinary quality |

While the preceding disclosure of the invention sets forth one embodiment and one use of the invention, it will be appreciated by those who are skilled in the art that many modifications and variations of the invention may be made without departing from the spirit of the invention. In as much, the appended claims are intended to encompass such changes and modifications in keeping with the spirit and scope of the invention.

What is claimed is:

1. A game apparatus for providing multi-skill simultaneous play of a knowledge-based game, said game apparatus comprising:

a spinner device having a spinner board with circular indicia forming a plurality of concentric rings, a rotatably affixed pointer device suitable for operation by a flick of a finger mounted at the geometric center of said concentric rings, a set of radial indicia dividing each concentric ring into a plurality of spaces, and instructional indicia disposed within each space each group of instructional indicia within a given concentric ring representing instructional indicia for a different skill level of play;

a plurality of sets of cards related to said concentric rings and said instructional indicia, each set of cards containing instructions for play actions for particular skill level of play; and a set of rules for play whereby players are divided into skill-level groups, each player following the instructions for play actions on cards drawn from a set of cards for his skill-level group according to the instructional indicia within the spaces of the appropriate skill-level ring of said spinner board, and thereby being pseudo-randomly assigned actions indicated on said card decks keyed to each player group's skill level.

2. The game apparatus of claim 1 further comprising color coding indicia of said rings on said spinner board to colors of said card decks.

3. The game apparatus of claim 1 further comprising numbers representing points to be awarded located in one of said rings on said spinner board.

4. The game apparatus of claim 1 wherein said instructional indicia within said spaces further comprise numbers relating to the length of words to be spelled, and wherein said card decks further comprise markings on said cards indicating the length of a word and a word to be spelled.

5. A method for allowing simultaneously play of a game by players of a plurality of skill-levels, said method comprising:

providing a spinner device having a plurality of concentric rings which are marked by radial dividers into spaces, each ring containing instructional indicia for a different skill level play;

providing a plurality of decks of cards, each of which contains play action instructions for a particular skill-level play;

providing a set of rules for play whereby each player is initially assigned or selects a skill level in which to play; and advancing the game by each player in following play action instructions given by a card drawn from a deck of cards as determined by the instructional indicia contained within a particular space in the appropriate skill-level ring selected by said spinner upon each spin of the spinner.

6. The method recited in claim 5 wherein said play action indicia comprises words to be spelled by the players.

* * * * *